US009481195B1

(12) United States Patent
Parkinson et al.

(10) Patent No.: US 9,481,195 B1
(45) Date of Patent: Nov. 1, 2016

(54) GREETING CARD WITH DIAL ACTIVATED AUDIO

(71) Applicant: American Greetings Corporation, Cleveland, OH (US)

(72) Inventors: Michelle Parkinson, Garfield Heights, OH (US); Lynne Shlonsky, Shaker Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/804,188

(22) Filed: Jul. 20, 2015

(51) Int. Cl.
*G09F 1/00* (2006.01)
*B42D 15/02* (2006.01)

(52) U.S. Cl.
CPC ..... *B42D 15/022* (2013.01)

(58) Field of Classification Search
USPC ..... 40/124.03; 446/404
See application file for complete search history.

(56) References Cited

U.S. PATENT DOCUMENTS

| | | | | |
|---|---|---|---|---|
| 4,299,041 | A | 11/1981 | Wilson | |
| 4,703,573 | A | 11/1987 | Montgomery et al. | |
| 5,356,296 | A | 10/1994 | Pierce et al. | |
| 5,382,188 | A * | 1/1995 | Tomellini | A63H 33/3016 434/309 |
| 5,671,555 | A | 9/1997 | Fernandes et al. | |
| 5,813,861 | A | 9/1998 | Wood | |
| 6,282,819 | B1 | 9/2001 | Gu | |
| 8,205,365 | B2 | 6/2012 | Taylor et al. | |
| 8,549,776 | B2 | 10/2013 | Guo et al. | |
| 8,595,961 | B2 | 12/2013 | Mayer et al. | |
| 8,763,285 | B2 | 7/2014 | Budzar et al. | |
| 8,887,418 | B2 | 11/2014 | Mayer et al. | |
| 2011/0151746 | A1* | 6/2011 | Rucker | A63H 3/28 446/297 |
| 2013/0074380 | A1 | 3/2013 | Mayer et al. | |
| 2014/0259817 | A1* | 9/2014 | Reynolds | G09F 1/00 40/124.02 |

* cited by examiner

*Primary Examiner* — Joanne Silbermann
(74) *Attorney, Agent, or Firm* — Christine Flanagan

(57) ABSTRACT

The greeting card of the present invention contains a user-interactive dial mechanism which can be manipulated to play different audio clips. The dial mechanism may be moveable, for example, between four different positions wherein moving the dial mechanism to each position triggers replay of a different audio clip at each of the four different positions.

20 Claims, 5 Drawing Sheets

GREETING CARD WITH DIAL ACTIVATED AUDIO

RELATED APPLICATIONS

There are no applications related to this application.

FIELD OF THE INVENTION

The present invention is in the field of social expression products, such as greeting cards. More specifically, the invention is directed to an interactive audio greeting card.

SUMMARY OF THE INVENTION

The greeting card of the present invention contains a user-interactive dial mechanism which can be manipulated to play different audio clips. The dial mechanism may be moveable, for example, between four different positions wherein moving the dial mechanism to each position triggers replay of a different audio clip at each of the four different positions.

DETAILED DESCRIPTION OF PREFERRED AND ALTERNATE EMBODIMENTS

Figure 1:
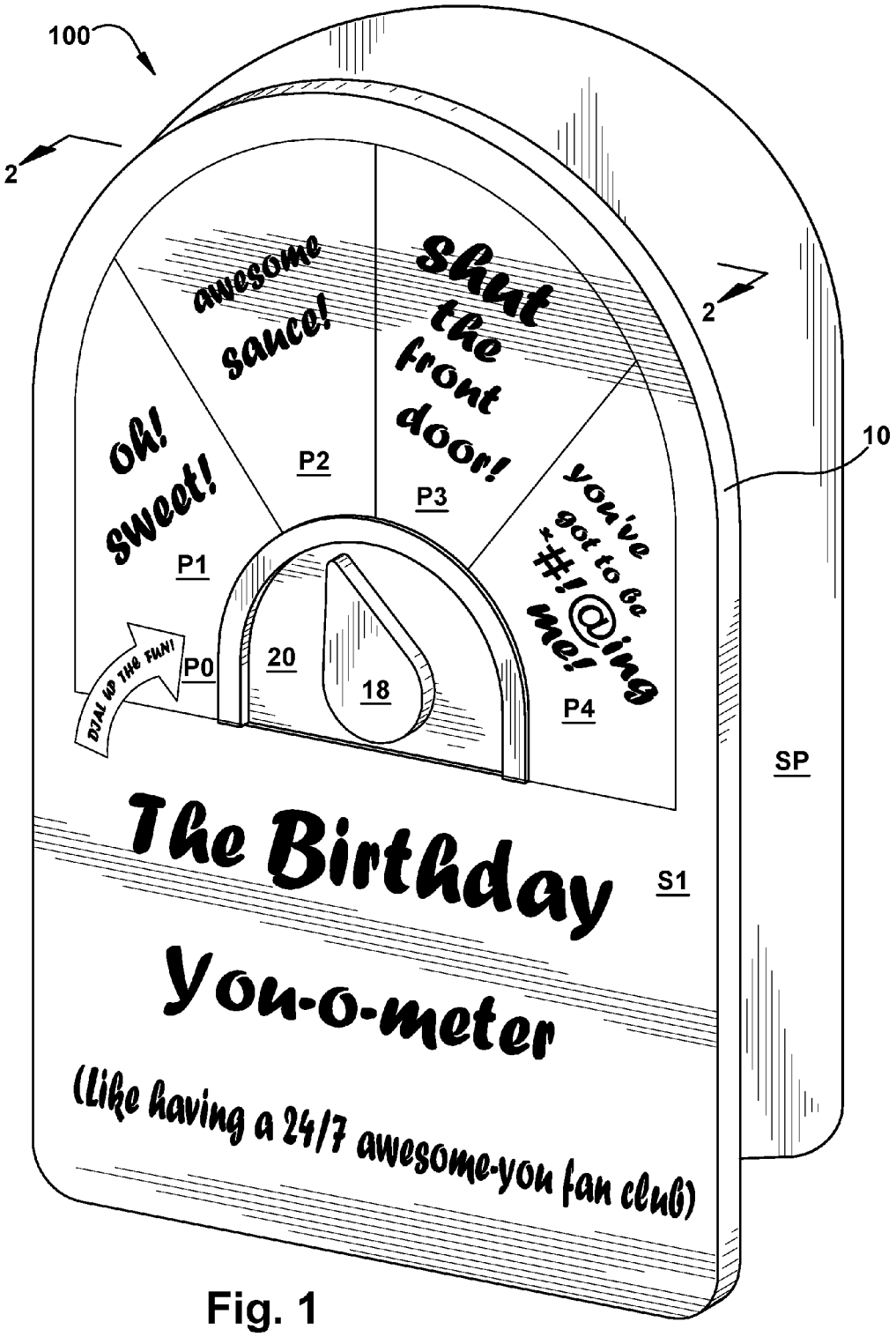
FIG. 1 is a perspective view of the greeting card of the present invention.

The present disclosure and related inventions is directed to an interactive audio greeting card. The greeting card contains a dial mechanism which can be manipulated by a user to play different audio clips.

The greeting card body contains a frame or construct 10, preferably made of foam (although other materials may be used). The foam construct 10 provides one or more openings or cavities therein for the placement and storage of the greeting card's electronic components. In a preferred embodiment, the foam construct 10 is approximately ¼-inch thick and contains a front surface, a rear surface, and a perimeter surface between the front and rear surfaces. The foam construct 10 may, as in the preferred embodiment, have a large opening which covers a substantial portion of the foam construct 10 and which extends from the front surface through to the rear surface, such that it acts as a frame which surrounds the electronic components. In other embodiments, the foam construct 10 may contain one or more cavities (which do not extend entirely between the front and rear surfaces) which contain the electronic components. In the preferred embodiment, the foam construct 10 contains a substantially straight horizontal lower portion with a right and left vertical sides extending upward therefrom, with an arched or arcuate upper portion. However, other shapes have been contemplated and are considered to be within the scope of the present invention. The front and rear surfaces of the foam construct or frame are covered by a substantially planar sheet material S1, S2, preferably made of paperboard (although other materials may be used). The substantially planar sheet material S1 which covers the front surface of the foam construct 10 is separate and distinct from the substantially planar sheet material S2 which covers the rear surface of the foam construct 10. The perimeter surface of the foam construct 10, in the preferred embodiment, is left uncovered. The substantially planar sheet material S1, S2 covering the front and rear surfaces is die cut into the shape of the foam frame or construct 10. It may contain text sentiment, photos, drawings, artwork or other printing contained thereon. The material S1, S2 is permanently attached to the foam frame or construct 10 via adhesive or other attachment mechanism. The substantially planar sheet material S2 which is attached to the rear surface of the foam frame or construct 10 may have a sentiment panel SP attached thereto. The sentiment panel SP is contiguous with the sheet material S2 covering the rear surface and is connected thereto along a bisecting fold line FL. The sentiment panel SP folds neatly over the outer surface of the rear sheet material S2 and is preferably of the same shape and size as the rear sheet material S2. The rear sheet material S2 and sentiment panel SP operate to form a traditional two panel greeting card which is attached to the rear surface of the foam frame or construct 10. The rear sheet material S2 and the front and back surfaces of the sentiment panel SP may contain text sentiment, photos, pictures, artwork or any other printing thereon. The sentiment panel SP also provides an area wherein the user can write a personal message and/or sign his/her name to the greeting card. While the foam frame or construct 10 has been described herein and shown in the figures as having a particular shape and size, other shapes and sizes are considered to be within the scope of the invention. Also, the substantially planar sheet material S1, S2 may be of any shape or size and may be separate and distinct sheets or may be a single contiguous sheet which envelopes the foam frame or construct 10. The material used may be of any suitable type and is not restricted to paperboard. The sentiment panel SP may be separate and distinct from the rear sheet material S2 and may be attached to the rear sheet material S2 and/or to the foam frame or construct 10 via any type of attachment means. Additionally, the substantially planar sheet material S1, S2 may contain embellishments attached thereto, such as googly eyes, gems, and other decorative effects. While the sheet material S1, S2 has been described as being substantially planar, it may be covered by a material such as faux fur, velvet, or any other fabric or material which may or may not contain a non-planar surface (including paperboard with a non-planar surface).

The electronic components of the greeting card 100 are concealed and contained within the large opening within the foam frame or construct 10. The electronic components may be attached directly to the front S1 or rear S2 sheet material or they may be attached to a separate substrate which may or may not be attached to the front S1 or rear S2 sheet material. The electronic components may include, but are not limited to: a printed circuit board 12, an integrated circuit chip, a speaker 14, a memory storage device having one or more audio files contained thereon, a power source 16, such as one or more small cell batteries (or other such power source), a switch, and related wiring and circuitry. The electronic components may additionally include any other component which is required for or which facilitates audio storage and playback. These components are known to one having skill in the art. Additional electronic components may be included for added special effects such as lighting (one or more lights), motor movement (small motor) or other such added effects.

Figure 2:
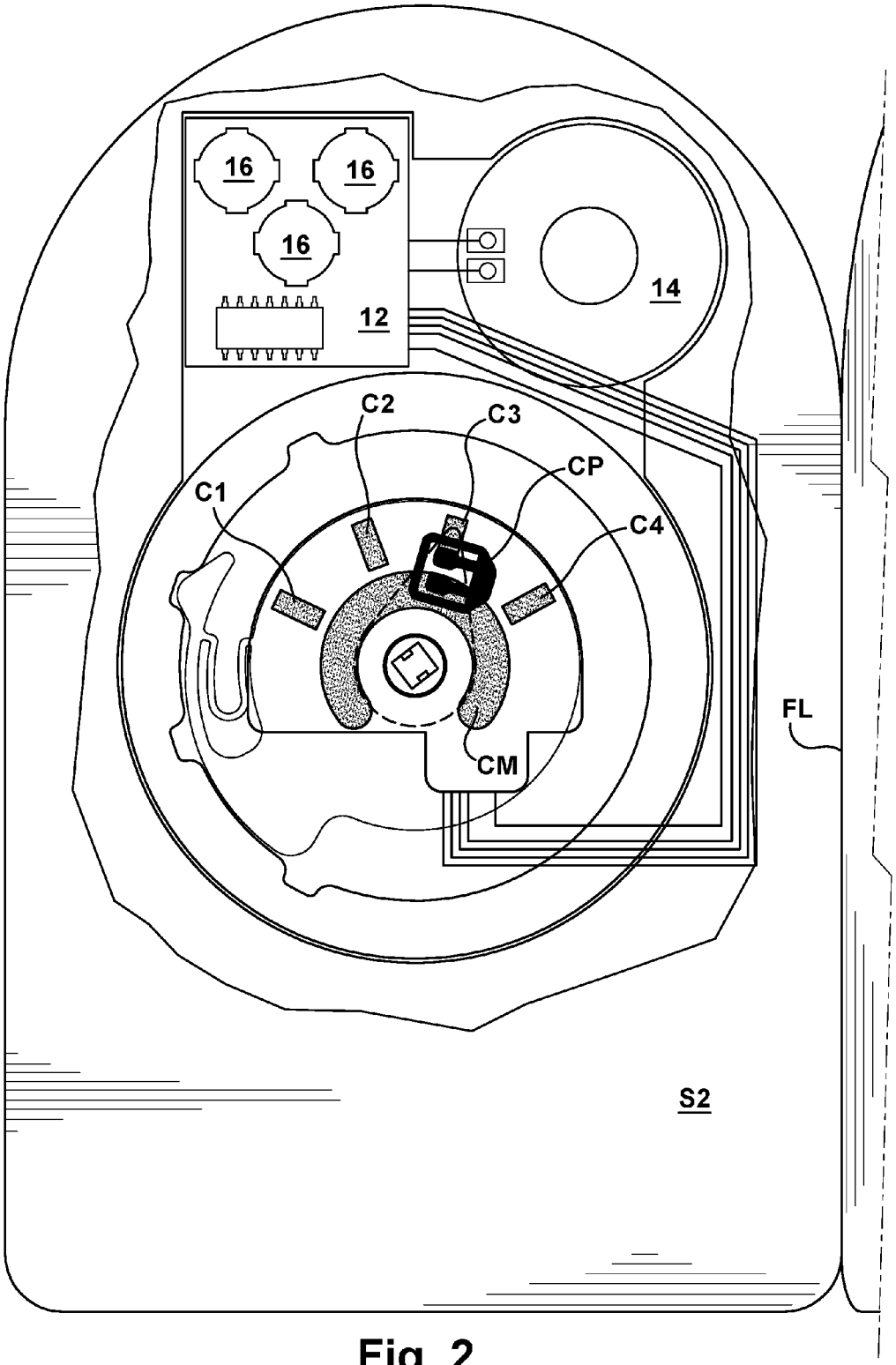
FIG. 2 is a front tear-away view of the greeting card of FIG. 1 (from the direction of arrows 2-2) with the dial mechanism in a first position.
Figure 3:
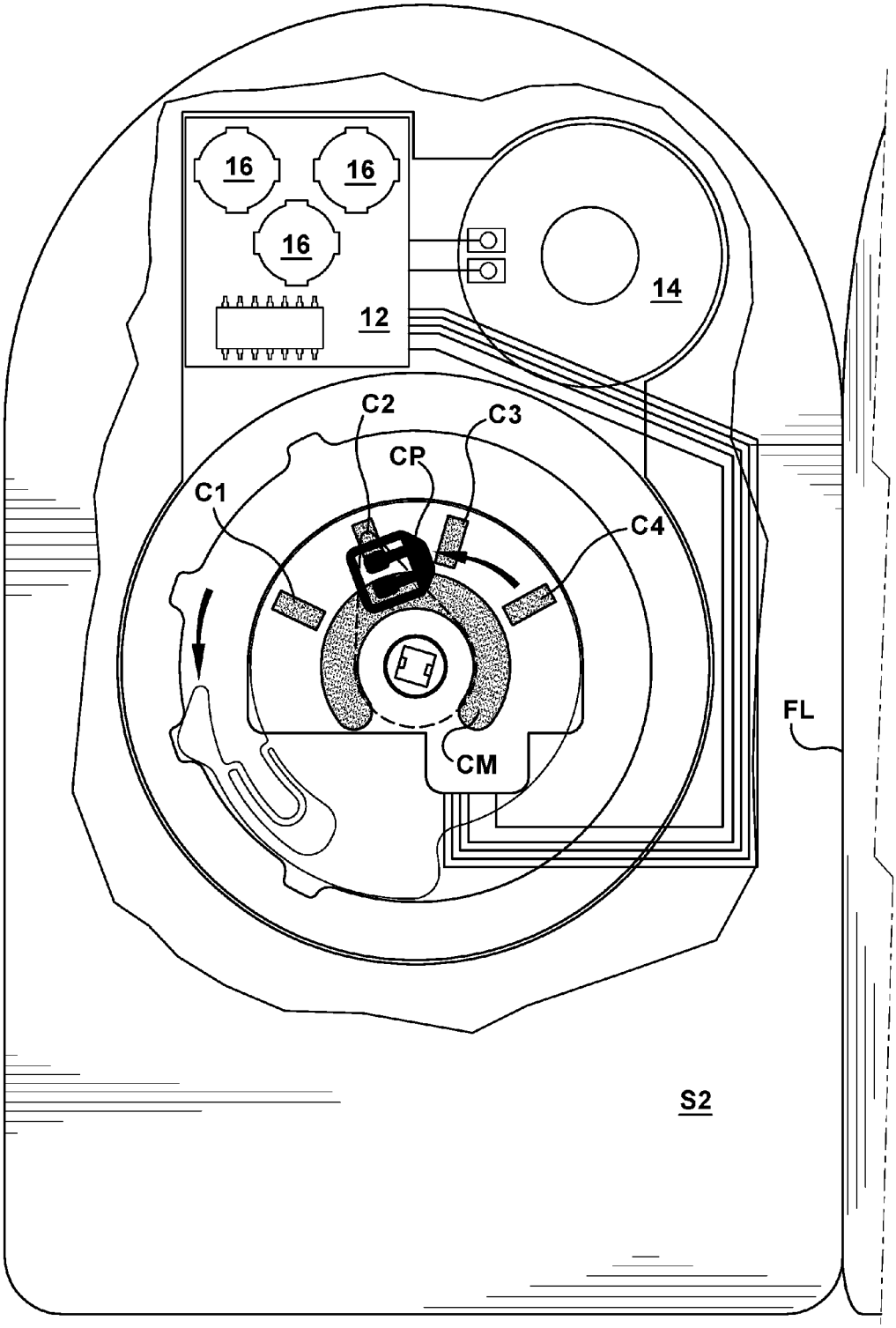
FIG. 3 is a front tear-away view of the greeting card of FIG. 1 with dial mechanism in a second position.
Figure 4:
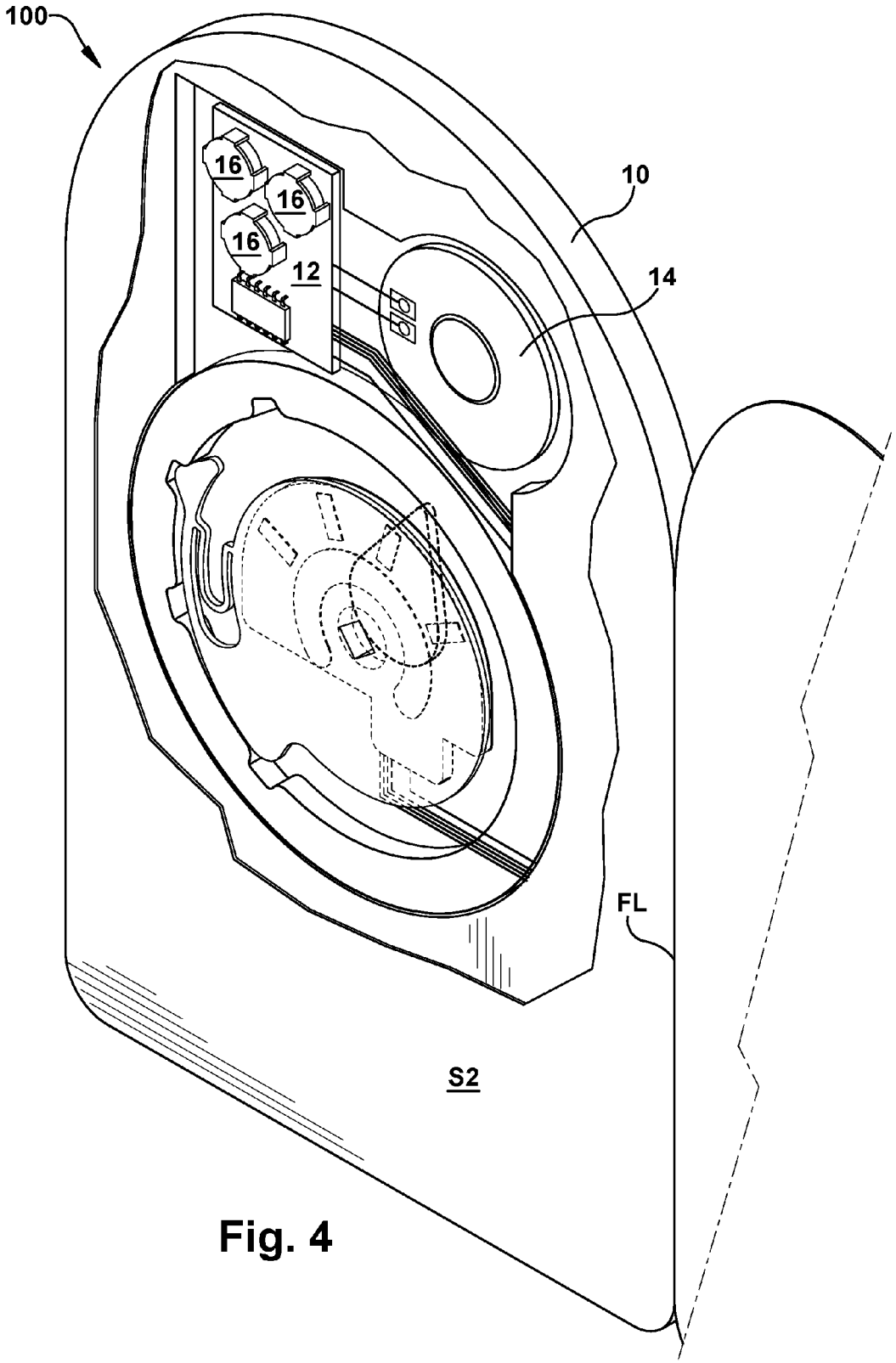
FIG. 4 is s perspective tear-away view of the greeting card of FIG. 1.
Figure 5:
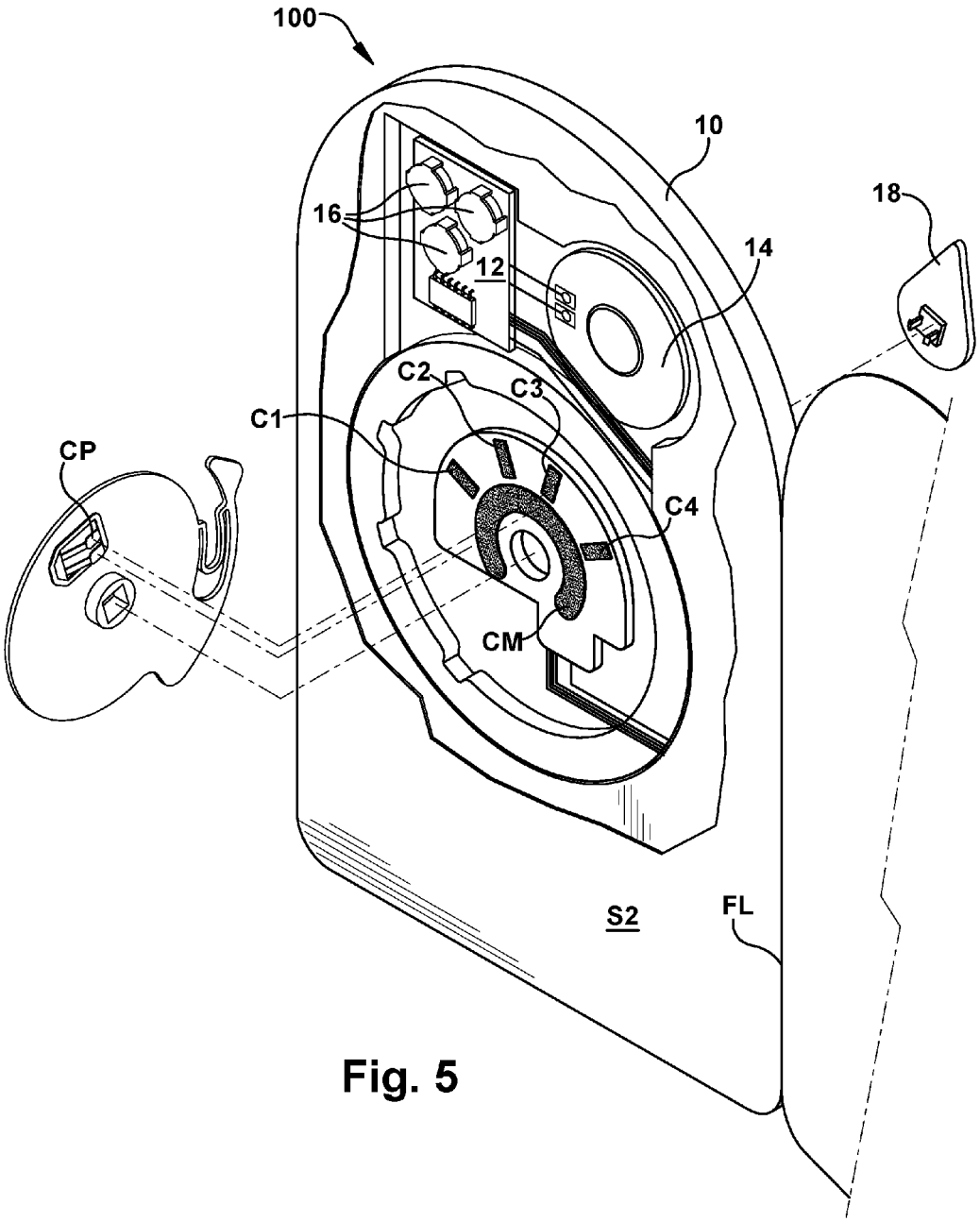
FIG. 5 is a perspective exploded view of the greeting card of FIG. 1.

A dial mechanism 18 operates to trigger playback of the audio files through the speaker 14. In a preferred embodiment, the dial 18 is accessible from the front of the greeting card 100, although in other embodiments, it may be on an inside surface of the greeting card 100 (having a cover or panel covering said dial mechanism). The dial mechanism 18 is tear drop-shaped (one end is pointed and the opposite end is arcuate or rounded). It is set in a lower, horizontally center portion 20 of the front greeting card panel (within a cutout in the front sheet material S1). The area 20 is slightly sunken or depressed so that the thickness of the dial 18 protrudes in an upward direction only slightly above (if at all) the face of the greeting card 100. In a preferred embodiment, the dial 18 can be moved from the "off" position P0 to one of four different audio positions P1-P4, as shown in FIG. 1. The "off" position P0 has the dial 18 pointing directly to the left. Moving the dial 18 from the "off" position P0 to the first position P1 involves moving the dial 18 to the right until the dial 18 mechanically "clicks" into the first position P1. The first position P1 has the pointed end of the dial directed substantially to the left but to the right of the "off" position P0. The next three positions P2, P3, P4 are reached by moving the dial from the first position P1, to the right, until it reaches the final or fourth position P4 wherein the pointed end of the dial 18 is facing substantially (but not completely) to the right. A contact switch is used to initiate a different audio clip at each of the four audio positions. The contact switch contains a two-pronged contact CP which is attached to the dial mechanism 18, as shown in FIG. 5. As the dial 18 is moved between the four dial positions P1-P4, the one prong of the two-pronged contact CP comes into contact with four individual contact strips C1-C4 placed below each dial position P1-P4, and the other prong of the two-pronged contact CP remains in contact with a main contact strip CM, which is located below each of the four individual contract strips C1-C4, in an arced arrangement, as shown in FIG. 5. Moving the dial 18 from the "off" position P0 to the first position P1 involves moving the dial 18 to the right until the dial mechanically "clicks" into the first audio position P1, wherein the two-pronged contact CP comes into direct contact with the first contact strip C1 (and also the main contact strip CM) thereby closing the circuit and causing a first audio clip to be emitted through the speaker 14. The user can continue to move the dial 18 to right into the next or second position P2 by moving the dial 18 to the right until the dial 18 mechanically "clicks" into the second position P2, wherein the two-pronged contact CP comes into direct contact with the second contact strip C2 (and the main contact strip CM) thereby closing the circuit and causing a second audio clip to be emitted through the speaker 14, as shown in FIG. 3. As with the first audio clip, once the full second audio clip is replayed, the audio stops. The second audio clip is different and distinct from the first audio clip. The user can continue to move the dial 18 to the right until the dial 18 mechanically "clicks" into the third position P3, wherein the two-pronged contact CP comes into direct contact with the third contact strip C3 (and the main contact strip CM) thereby closing the circuit and causing a third audio clip to be emitted through the speaker 14, as shown in FIG. 2. Further moving the dial 18 to the right until the dial "clicks" into the fourth or last position, wherein the two-pronged contact CP comes into direct contact with the fourth contact strip C4 (and the main contact strip CM) thereby closing the circuit and causing a fourth audio clip to be emitted though the speaker 14. From any position on the dial 18, the dial 18 can be moved to any other position on the dial 18. For example, the user may move the dial 18 from the "off" position P0 to the third position P3 or from the fourth position P4 back to the second position P2. Each time the full length of each audio clip has been replayed, the audio stops while the dial 18 remains at that location. For example, when the dial 18 moves to the first position P1, after the first audio clip has been replayed, the audio stops and the dial 18 remains at the first position P1, until the user moves it to another position on the dial 18. Each audio clip is different from each of the other audio clips. When one of the prongs on the two-pronged contact CP touches one of the four contact strips C1-C4, the individual contact strip determines which audio file gets replayed through the speaker. In a preferred embodiment, each audio clip is related in theme or context to each of the other audio clips and also to the printing on the greeting card 100. For example, if the greeting card 100 is a birthday card, the text on the greeting card 100 may say, for example, "The Birthday Old-O-Meter (Behold the Glories of Aging)" and each of the audio clips may relate to humorous sayings or phrases regarding aging. The text above each position on the dial P1, P2, P3, P4 may read "Officially Old"; "Cranky Pants"; "Over the Hill"; and "Fossil" while each corresponding audio clip says something to that effect. In another example, the greeting card 100 is a birthday card and the text on the card 100 reads, "The Birthday Beer-O-Meter". The different dial positions may read, "One Beer" (P1); "Two Beers" (P2); "Three Beers" (P3), and "Floor" (P4). Each corresponding audio clip is a phrase by a person who gradually sounds like he/she is becoming increasingly intoxicated. The audio or sound clips may contain phrases or statements which embody the "dial-it-up" aspect of the card wherein turning the dial 18 up causes the audio or sound clips to get more severe, increase in sound, increase or change in tone, or otherwise represent or exemplify an increasing, accumulative, or heightened nature of the typical dial mechanism 18.

In an alternate embodiment, the concept of having a user-interactive dial-based audio trigger can be used in connection with a gift bag or a gift box. The gift bag may be of the traditional type having four side panels, a bottom panel and an open end opposite the bottom panel for inserting into and removing gifts or other items therefrom. One or more of the four side panels may be double walled with the electronic components of the greeting card (described above with respect to the greeting card embodiment) contained between the two walls of the double walled panel and having the dial mechanism and related printing (described above with respect to the greeting card embodiment) contained on an outside surface of the double walled panel. The gift box may have a four sided box portion with a bottom panel and an open end opposite the bottom panel. A lid portion of the box may be hingedly attached to the box portion or may be completely removable from the box portion. The lid may contain a top panel with four smaller side panels extending perpendicular and downward from the top panel. The lid is slightly larger than the box portion so that the lid can fit over the open end of the box portion to create a closed container. The lid may contain a compartment beneath the top portion that contains the electronic components (described above with respect to the greeting card embodiment) therein. The dial mechanism and corresponding print (described above with respect to the greeting card embodiment) may be contained on the top portion of the lid portion of the box.

While the greeting card, gift bag and gift box embodiments of the present invention have been described herein and shown in the figures as having certain shapes, sizes, types of switch or trigger methods, types of sound effects or audio, as pertains to the preferred embodiment, these features are described herein only as examples of the invention and are not meant to limit the invention in any way. The dial mechanism can be replaced with a slide lever, a series of press-buttons, a pull tab, or any other trigger mechanism which allows the user to iterate between the different sound or audio clips.

The invention claimed is:

1. An interactive greeting card comprising:

a greeting card body comprising a foam construct, a planar sheet material attached to a front surface and a rear surface of the foam construct, and a sentiment panel attached to the planar sheet material attached to the rear surface of the foam construct, the foam construct having at least one cavity therein;

a dial mechanism attached to a front surface of the greeting card body, the dial mechanism being capable of moving between at least two different positions;

a sound module having at least two different audio files saved thereon, the sound module capable of playing back the;

wherein moving the dial to a first position initiates playback of a first of the at least two different audio files and moving the dial to a second position initiates playback of a second of the at least two different audio files.

2. The interactive greeting card of claim 1, wherein the dial mechanism is located on a front face of the greeting card body.

3. The interactive greeting card of claim 1, wherein the sound module has four different audio files saved thereon.

4. The interactive greeting card of claim 3, wherein the dial mechanism is operative to moves between four different positions.

5. The interactive greeting card of claim 4, wherein moving the dial to a third position initiates a third of the four different audio files and moving the dial to a fourth position initiates a fourth of the four different audio files.

6. The interactive greeting card of claim 1, wherein a portion of the greeting card body is made of foam.

7. The interactive greeting card of claim 1, wherein the greeting card body contains a sentiment panel attached to a rear surface thereof along a fold line.

8. An interactive greeting card comprising:

a three-dimensional greeting card body having at least one cavity therein;

a sound module operative to which stores and can playback at least three different audio files through a speaker, the sound module contained in the at least one cavity of the three-dimensional greeting card body;

a substantially planar sheet material attached to a substantial portion of the front surface of the three-dimensional greeting card body;

a dial mechanism attached to the three-dimensional greeting card body, the dial mechanism being moveable between at least three different positions;

wherein moving the dial mechanism to a first of the three positions triggers playback of a first of the at least three different audio files and moving the dial mechanism to a second of the three positions triggers playback of a second of the at least three different audio files and moving the dial mechanism to a third of the at least three positions triggers playback of a third of the at least three audio files.

9. The interactive greeting card of claim 8, wherein the substantially planar sheet material attached to a substantial portion of the front surface of the three-dimensional greeting card body contains printing thereon which indicates where the three different positions in which the dial mechanism can move are located.

10. The interactive greeting card of claim 8, wherein the at least three different audio files are related by theme to each other and to printing contained on the substantially planar sheet material.

11. The interactive greeting card of claim 8, wherein each successive audio file becomes louder as the dial is moved between the first, second and third positions.

12. The interactive greeting card of claim 8, wherein each successive audio file becomes slower as the dial is moved between the first, second and third positions.

13. The interactive greeting card of claim 8, wherein the three-dimensional greeting card body contains a two panel greeting card sentiment panel attached to the rear surface thereof.

14. The interactive greeting card of claim 8, wherein the dial mechanism is operable to move in a right-to-left and a left-to-right direction.

15. The interactive greeting card of claim 8, wherein the dial mechanism is located in a slightly recessed portion of the three-dimensional greeting card body.

16. An interactive greeting card comprising;

a greeting card body having a front surface, a rear surface opposite the front surface and a perimeter surface which extends between the front and rear surface, the greeting card body having at least one cavity contained therein;

a sound module contained within the at least one cavity contained within the greeting card body, the sound module having at least two audio files stored thereon and being capable of playing back the at least two audio files through a speaker;

a dial which can be moved to at least three different positions, wherein one of the at least three different positions is an "off" position;

wherein moving the dial to an "off" position turns the greeting card "off", moving the dial to a first position triggers playback of a first one of the at least two audio files and moving the dial to a second position triggers playback of a second one of the at least two audio files.

17. The interactive greeting card of claim 16, wherein the at least two audio files contain two different spoken audio clips.

18. The interactive greeting card of claim 16, wherein printing on the greeting card body surrounding the dial indicates the location of the first and second positions.

19. The interactive greeting card of claim 16, wherein the greeting card body contains a sentiment panel attached to the rear surface thereof.

20. The interactive greeting card of claim 16, wherein the dial can be moved in both a forward and backward direction.

* * * * *